US010173413B2

(12) United States Patent
Chen

(10) Patent No.: US 10,173,413 B2
(45) Date of Patent: Jan. 8, 2019

(54) ROTARY PRINTING MACHINE

(71) Applicant: ATMA CHAMP ENTERPRISE CORPORATION, New Taipei (TW)

(72) Inventor: Tung Chin Chen, New Taipei (TW)

(73) Assignee: ATMA CHAMP ENTERPRISE CORPORATION, New Taipei (TW)

( * ) Notice: Subject to any disclaimer, the term of this patent is extended or adjusted under 35 U.S.C. 154(b) by 248 days.

(21) Appl. No.: 15/375,902

(22) Filed: Dec. 12, 2016

(65) Prior Publication Data

US 2018/0162116 A1 Jun. 14, 2018

(51) Int. Cl.

| | |
|---|---|
| ***B41F 21/10*** | (2006.01) |
| ***B41F 3/54*** | (2006.01) |
| ***B41F 15/08*** | (2006.01) |
| ***B41J 11/00*** | (2006.01) |
| ***B41J 13/22*** | (2006.01) |
| ***B41F 21/00*** | (2006.01) |

(52) U.S. Cl.

CPC ..... *B41F 3/54* (2013.01); *B41F 15/0804* (2013.01); *B41F 21/00* (2013.01); *B41F 21/104* (2013.01); *B41J 11/002* (2013.01); *B41J 13/223* (2013.01)

(58) Field of Classification Search

CPC ..... B41F 3/54; B41F 15/0804; B41F 21/00; B41F 21/104; B41J 11/002; B41J 13/223

See application file for complete search history.

(56) References Cited

U.S. PATENT DOCUMENTS

| | | | | |
|---|---|---|---|---|
| 5,706,722 A * | 1/1998 | Kurten | B41F 15/0827 101/124 |
| 6,109,173 A * | 8/2000 | Nakayama | B41L 13/06 101/118 |
| 7,073,439 B2 * | 7/2006 | Takahashi | B41F 13/02 101/424.1 |
| 9,051,147 B2 * | 6/2015 | Liao | B65H 19/29 |

FOREIGN PATENT DOCUMENTS

| | | | | |
|---|---|---|---|---|
| DE | 4444189 | * | 8/1994 | B41F 15/0813 |
| EP | 0412318 | * | 7/1990 | B41F 15/0827 |
| WO | 2006051558 | * | 5/2006 | B41F 15/0827 |

* cited by examiner

*Primary Examiner* — Jill Culler
*Assistant Examiner* — Marissa Ferguson Samreth
(74) *Attorney, Agent, or Firm* — Rabin & Berdo, P.C.

(57) ABSTRACT

A rotary printing machine includes a printing cylinder, at least one clamping unit mounted on a printing surface of the printing cylinder, and a feeding control mechanism and an unloading control mechanism mounted to a lateral side of the printing cylinder for changing the clamping state of the clamping unit. When the clamping unit is moved to an unloading position, the unloading control mechanism can be operated to control the clamping unit to maintain a closed state, so that a workpiece can be brought by the printing cylinder to a feeding position again. Then, the feeding control mechanism can be operated to control the clamping unit at the feeding position to maintain a clamped state, so that printing can be repeated on the workpiece to form multiple layers of ink and create three-dimensional printed layers showing a specific visual effect.

14 Claims, 15 Drawing Sheets

2

ROTARY PRINTING MACHINE

FIELD OF THE INVENTION

The present invention relates to a printing machine, and more particularly to a rotary printing machine, with which a workpiece can be printed only once or be repeated printed multiple times in a continuous manner.

BACKGROUND OF THE INVENTION

Generally, a screen printing machine includes only one clamping unit on a printing cylinder thereof. When the clamping unit is located at a feeding position, it clamps a workpiece in place on the printing cylinder. Then, the printing cylinder continuously rotates and brings the workpiece to a position corresponding to a screen carrier, and the screen carrier is caused to move horizontally while the printing cylinder rotates, so that a printed pattern is formed on the workpiece that is located between the printing cylinder and the screen carrier. Thereafter, when the workpiece is moved to an unloading position, the clamping unit releases the workpiece, so that the workpiece leaves from the printing cylinder and the screen printing procedure is completed. Thereafter, the printing cylinder keeps rotating and reaches at the feeding position again. At this point, the clamping unit is in an open state and ready for clamping a next workpiece. Since the screen printing machine with one single clamping unit can complete only one printing operation when the printing cylinder rotates a full circle of 360 degrees, the printing efficiency thereof is very low.

To improve the performance of the conventional screen printing machine, an improved screen printing machine 1 with multiple clamping units as shown in FIG. 1 has been introduced into the market. Please refer to FIG. 1. The improved screen printing machine 1 includes a printing cylinder 10, a screen carrier 11, a first clamping unit 12, a second clamping unit 13, a first servomotor 14, a second servomotor 15, and a controller 16. The first servomotor 14 and the second servomotor 15 are driven by the controller 16 to synchronously move the screen carrier 11 and the printing cylinder 10, respectively. The first clamping unit 12 and the second clamping unit 13 are located at two diametrically opposite positions on the printing cylinder 10.

When the printing starts, the first clamping unit 12 located at a feeding position is in an open state, allowing a workpiece to be moved into the first clamping unit 12. Then, the first clamping unit 1 is closed, bringing the workpiece to move circumferentially along with the rotating printing cylinder 10. Then, printing and unloading procedures are sequentially performed. When the first clamping unit 12 completes the unloading procedure, the second clamping unit 13 is located at the feeding position and ready for clamping a next workpiece. When the second clamping unit 13 completes the printing and the unloading procedures, the first clamping unit 12 is returned to the feed position again and starts a new cycle of clamping, printing and unloading procedures. That is, the improved screen printing machine 1 is able to complete printing on two workpieces when the printing cylinder 10 rotates one full circle of 360 degrees. This largely increases the printing efficiency of the screen printing machine.

However, most screen printing machines available in the market are designed for the workpiece to be printed only once. That is, the printed pattern formed on the workpiece is a two-dimensional pattern having one single layer of ink. Therefore, when the conventional screen printing machine is to be used to form a three-dimensional printed pattern including multiple layers of ink on the workpiece, the workpiece must be manually removed from an unloading unit of the screen printing machine each time one printing procedure is completed and then, be manually put in a feeding unit of the screen printing machine to repeat the screen printing until the three-dimensional printed pattern is obtained. By doing this, the time for printing is increased and it is uneasy to control the accuracy of manual printing registration. Accordingly, the printing quality and productivity are relatively low, and the complicated procedures for the three-dimensional printing also largely increase the cost of the screen printed pattern. In view that the conventional screen printing machine has a lot of disadvantage in use, it is really desirable to improve the structure of the currently available rotary screen printing machine.

SUMMARY OF THE INVENTION

A primary object of the present invention is to provide a rotary printing machine, with which a workpiece can be printed only once or be repeatedly print multiple times in a continuous manner, so that only one rotary printing machine is needed to print on a workpiece for forming a two-dimensional printed pattern with one single layer of ink or forming a three-dimensional printed pattern with multiple stacked layers of ink, depending on actual need in use. Therefore, the rotary printing machine can have increased applications and the conventional complicated procedures for creating a three-dimensional printed pattern can be simplified.

Another object of the present invention is to provide a rotary printing machine, of which a printing cylinder has a plurality of clamping units provided thereon, so that multiple workpieces can be printed in one revolution of the printing cylinder to largely upgrade the printing efficiency of the rotary printing machine.

To achieve the above and other objects, the rotary printing machine provided according to the present invention includes a printing cylinder, a printing unit, a feeding control mechanism and an unloading control mechanism. By controlling the feeding control mechanism and the unloading control mechanism corresponding to the rotation of the printing cylinder, a workpiece can be printed only once or be repeatedly printed multiple times in a continuous manner.

In the present invention, the printing cylinder is provided on a surface thereof with at least one clamping unit. The clamping unit includes a rotary shaft, on which a swing member, a reset unit and a plurality of clampers are provided. The clampers are normally maintained in a closed state on the surface of the printing cylinder, and can be switched to an open state when the rotary shaft of the clamping unit is rotated. When the clampers are in the closed state, a clamping surface formed by the clampers overlaps with the surface of the printing cylinder to provide a clamping effect. When the clampers are in the open state, an angle is formed between the clamping surface of the clampers and the surface of the printing cylinder to provide a releasing effect.

In a preferred embodiment of the present invention, the clamper includes a clamping section and a pushing section, both of which are fixedly mounted on the rotary shaft. The pushing section overlaps with the printing cylinder when the rotary shaft is acted on by the feeding control unit. On the other hand, an angle is formed between the pushing section and the surface of the printing cylinder when the rotary shaft is acted on by the unloading control unit. An angle formed between the clamping unit and the printing cylinder when the rotary shaft is acted on by the feeding control mechanism is different from an angle that is formed between the clamping section and the printing cylinder when the rotary shaft is acted on by the unloading control mechanism.

In the present invention, the printing unit is located over and adjacent to the surface of the printing cylinder for performing printing on the workpiece in cooperation with the printing cylinder. In an operable embodiment, the printing unit uses an inkjet member to jet ink directly onto the workpiece. In another operable embodiment, the printing unit uses a screen carrier to perform screen printing on the workpiece.

In the present invention, the feeding control mechanism includes a driving source, a feeding linkage and a feeding control unit. The driving source drives the feeding linkage to change between a first position, in which the feeding linkage can touch the swing member when the printing cylinder is rotating, and a second position, in which the feeding linkage can not touch the swing member when the printing cylinder is rotating. The feeding control unit is able to separate the feeding linkage from the driving source, such that the feeding linkage is maintained at the second position.

In a preferred embodiment, the driving source is configured as a cam. The cam has a first curved portion and a second curved portion that are different in curvature. The clampers are brought to quickly change from the closed state into the open state when the first curved portion and the second curved portion of the cam sequentially act on the feeding linkage; and the clampers are brought to gently change from the open state into the closed state when the second curved portion and the first curved portion of the cam sequentially act on the feeding linkage.

The feeding linkage includes a first link and a second link. The first and the second link are fixedly connected to each other at their adjacent ends, which together form a pivot center. The driving source and the feeding control unit are operatively mounted on the first link, and another opposite end of the second link is movable to touch the swing member for rotating the rotary shaft.

The second link includes a swing link body, a push head connected to one side of a distal end of the swing link body for causing the swing member to swing, and a length-adjustment mechanism located between the swing link body and the push head.

The length-adjustment mechanism includes a first limiting rail and a first locking member. The first limiting rail is formed on one of the swing link body and the push head while the first locking member is mounted the other one of the swing link body and the push head; and the push head is movable in along the first limiting rail to thereby change an overall length of the second link.

In the present invention, the feeding control unit includes a first driving unit and a first controller. The first driving unit is normally in a retracted state, and the first controller is electrically connected to the first driving unit for controlling the first driving unit to change from the retracted state into an extended state.

The unloading control mechanism includes an unloading unit and an unloading control unit. The unloading unit is mounted to the first position, in which the unloading unit can touch the swing member when the printing cylinder is rotating; and the unloading control unit is able to switch the unloading unit from the first position to the second position, in which the unloading unit can not touch the swing member when the printing cylinder is rotating.

The unloading unit has an end fixed to the printing cylinder to serve as a pivot center and another opposite end connected to the unloading control unit. A raised area is formed on the unloading unit between the pivot center and the unloading control unit, and the raised area is higher than other areas of the unloading unit located at two lateral sides of the raised area.

The unloading unit includes a curved arm portion, a raised arm portion that forms the raised area, and a position-adjustment mechanism formed on between the curved arm portion and the raised arm portion.

The position-adjustment mechanism includes a second limiting rail and a second locking member. The second limiting rail is formed on one of the curved arm portion and the raised arm portion while the second locking member is mounted on the other one of the curved arm portion and the raised arm portion. The raised arm portion is movable in along the second limiting rail when the second locking member is in a loosened state, enabling a change in a connection position of the raised arm portion relative to the curved arm portion.

The unloading control unit includes a second driving unit and a second controller. The second driving unit is normally in an extended state, and the second controller is electrically connected to the second driving unit for controlling the second driving unit to change from the extended state into a retracted state.

When the first driving unit of the rotary printing machine of the present invention is controlled to the retracted state and the second driving unit is controlled to the extended state, the printing cylinder can circumferentially move the workpiece for the printing unit to print on the workpiece once only. On the other hand, when the first driving unit of the rotary printing machine of the present invention is controlled to the extended state and the second driving unit is controlled to the retracted state, the printing cylinder can circumferentially move the workpiece for the printing unit to repeat printing on the workpiece multiple times in a continuous manner.

The rotary printing machine of the present invention can further include a drying unit disposed over the unloading control mechanism for curing ink that has been printed onto the workpiece to form a pattern, so that the cured printed pattern is stably held to the workpiece. After the curing operation, the workpiece is still in a clamped state and attached to the printing cylinder, so as to be circumferentially moved by the rotating printing cylinder for a next printing operation. The same steps are repeated multiple times to form a user-required three-dimensional printed pattern on the workpiece. In a preferred embodiment, the drying unit is configured as an ultraviolet (UV) lamp.

The rotary printing machine of the present invention is characterized in that the clamping units provided on the printing cylinder work in cooperation with the mechanically operated feeding control mechanism and unloading control mechanism, it is therefore possible to determine the operating states of the clamping units at the feeding position and the unloading position. With these arrangements, the workpiece on the rotary printing machine can be printed only once without the need of adjusting the rotary printing machine. On the other hand, when the workpiece on the rotary printing machine is to be repeatedly printed multiple times, simply adjust the feeding control mechanism and the unloading control mechanism for the clamping units to maintain the clamped state, and a three-dimensional printed pattern with multiple layers of ink can be formed on the workpiece.

Moreover, in the rotary printing machine of the present invention, the use of dual clamping units along with the inkjet member or a screen carrier enables a fully automatic three-dimensional electronic printing operation, which can effectively reduce the labor and time costs to upgrade the printing efficiency.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

The present invention will now be described with a preferred embodiment thereof and by referring to the accompanying drawings.

Figure 1:
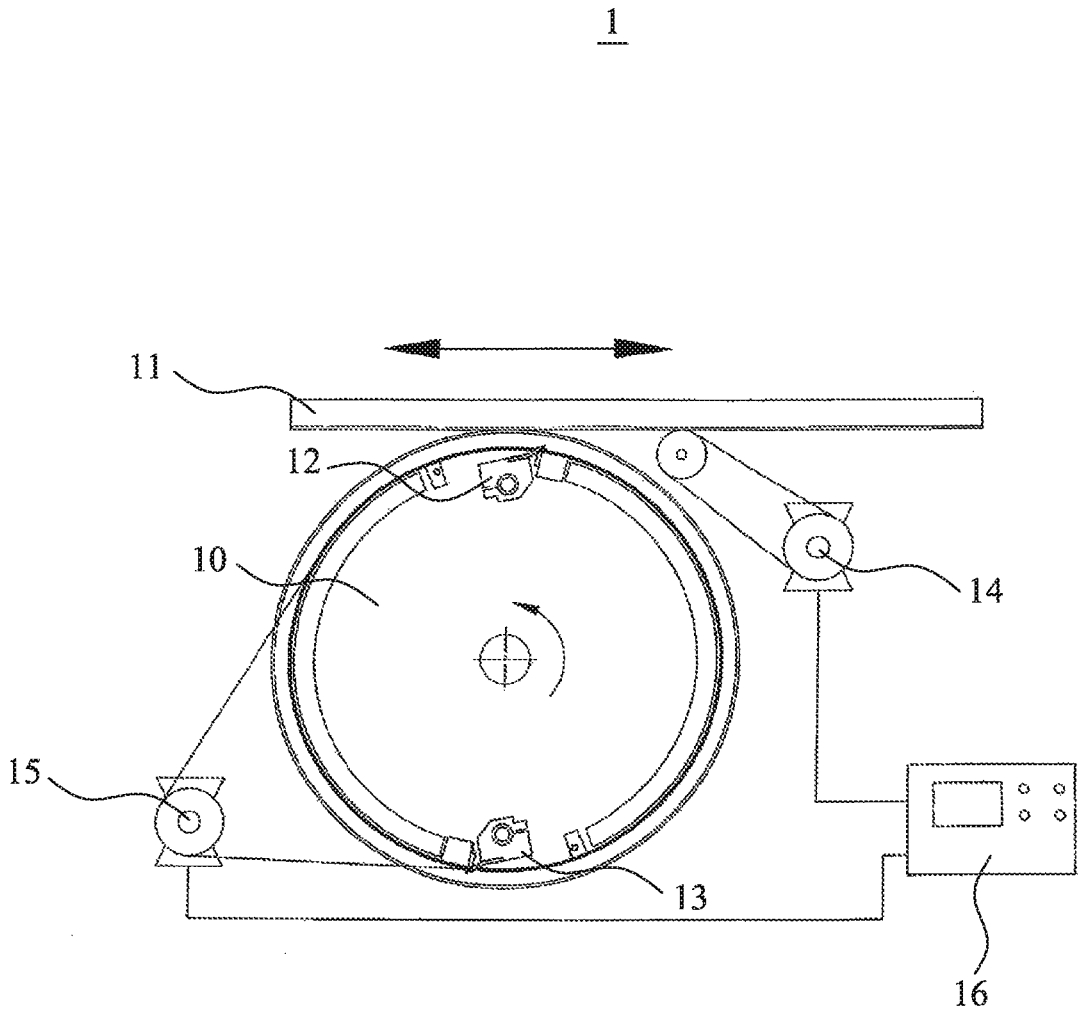
FIG. 1 (Prior Art)
FIG. 1 is a side view of a conventional rotary screen printing machine with two clamping units.
Figure 2:
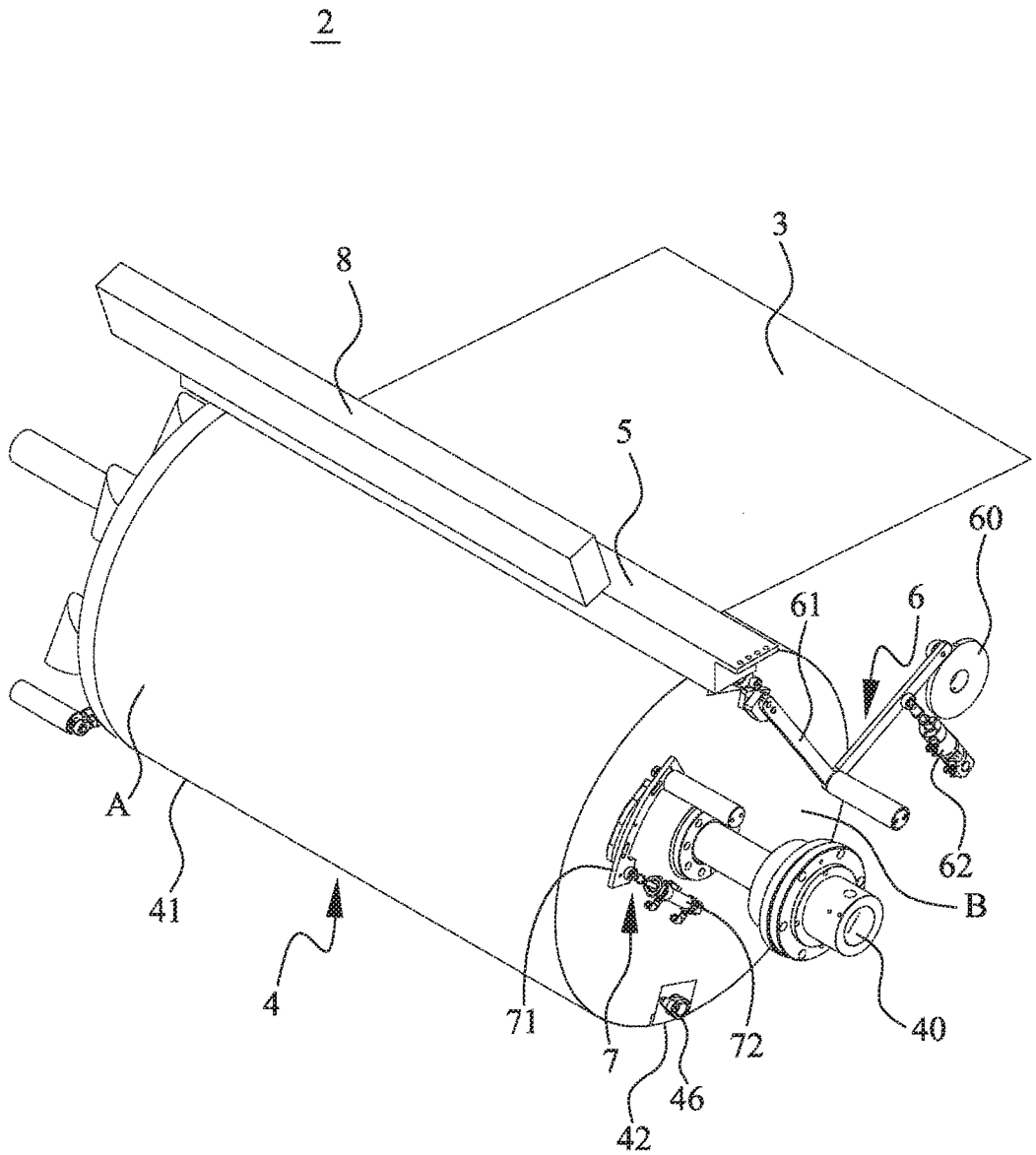
FIG. 2 is a perspective view of a rotary printing machine according to a preferred embodiment of the present invention.

Please refer to FIG. 2. A rotary printing machine 2 according to a preferred embodiment of the present invention is mainly characterized by improving a printing mechanism located between a feeding mechanism and an unloading mechanism, so that the rotary printing machine 2 can be selectively operated for a workpiece 3 to be printed only once or be repeatedly printed multiple times in a continuous manner. The rotary printing machine 2 of the present invention includes a printing cylinder 4, a printing unit 5, a feeding control mechanism 6, an unloading control mechanism 7, and a drying unit 8.

The printing cylinder 4 is driven to rotate by a servomotor (not shown), which enables precisely controlled rotational speed and accuracy of the printing cylinder 4. The printing unit 5 is installed over the printing cylinder 4 and located adjacent to a printing surface A of the printing cylinder 4. The printing unit 5 performs printing on the workpiece 3 corresponding to the rotation of the printing cylinder 4. In the embodiment illustrated in FIG. 2, the printing unit 5 uses an inkjet member to jet ink directly onto the workpiece 3. In another operable embodiment, the printing unit 5 uses a screen carrier, which is driven to move by another servomotor, to perform screen printing on the workpiece 3.

The feeding control mechanism 6 and the unloading control mechanism 7 are mounted to a non-printing surface B located at one lateral side of the printing cylinder 4. The drying unit 8 is disposed over the unloading control mechanism 7 for performing an ink curing operation on the workpiece 3 that has printed patterns formed thereon.

The printing cylinder 4 includes a driving shaft 40, a cylinder body 41, and at least one clamping unit 42. In an operable embodiment, two clamping units 42 are provided on the cylinder body 41 at two diametrically opposite positions thereof. With these arrangements, the printing on two workpieces 3 can be completed in one revolution of the cylinder body 41. However, it is understood the provision of two clamping units 42 is only illustrative. That is, the designed number of the clamping units 42 can be three, four or more, depending on actual need.

Figure 3:
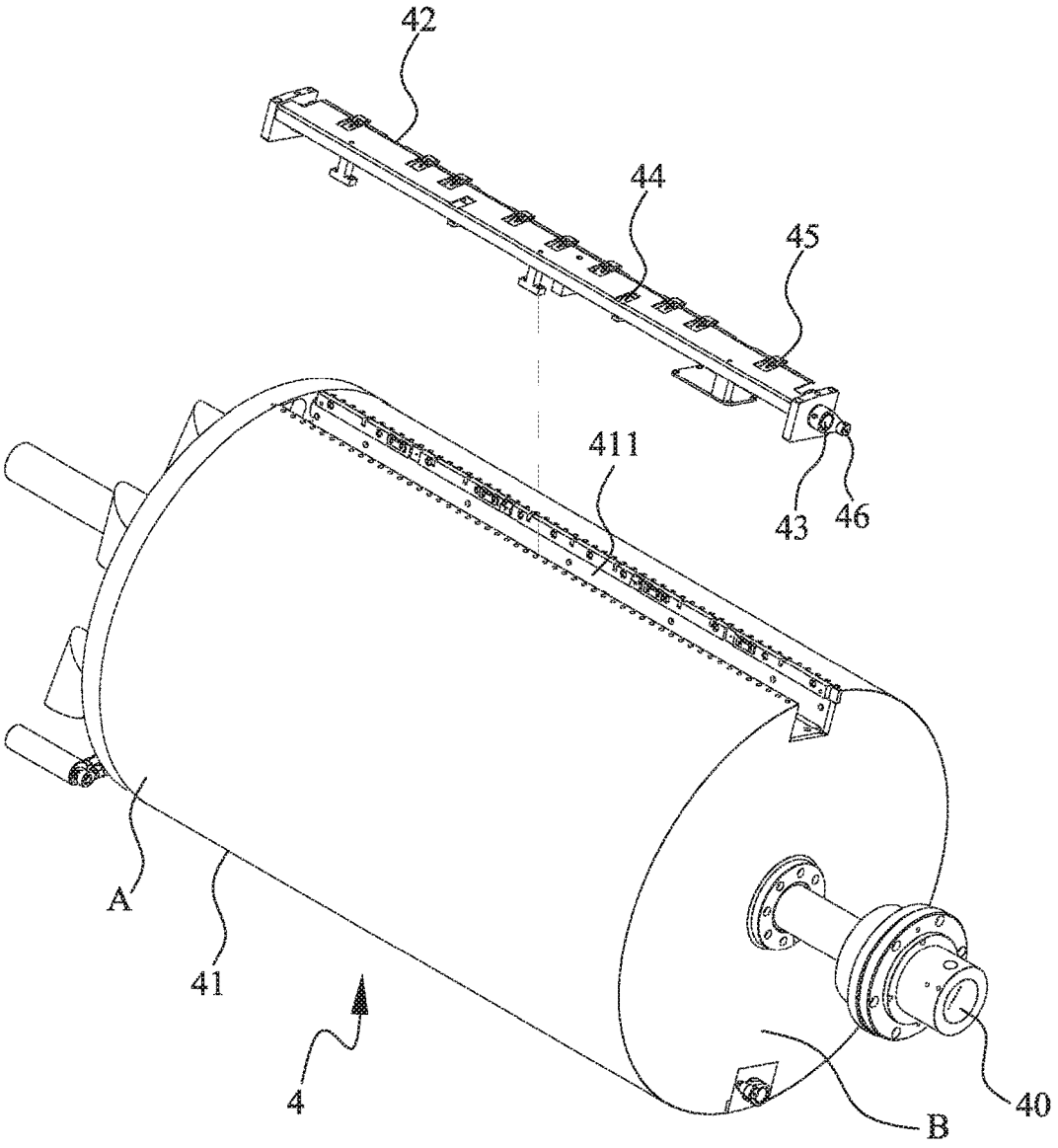
FIG. 3 is an exploded perspective view of a printing cylinder for the rotary printing machine of FIG. 2.

Please refer to FIG. 3. The cylinder body 41 has two recessed areas 411 formed on a circumferential surface thereof. The two clamping units 42 are separately installed in the two recessed areas 411. Each of the clamping units 42 includes a rotary shaft 43, which is connected to a position of the cylinder body 41 close to the circumferential surface thereof. At least one reset unit 44 and a plurality of clampers 45 are provided on one side of the rotary shaft 43 that faces toward the printing surface A. And, a swing member 46 is provided on an end of the rotary shaft 43 facing toward the non-printing surface B of the printing cylinder 4. The swing member 46, the feeding control mechanism 6 and the unloading control mechanism 7 are located at the same lateral side of the cylinder body 41.

Figure 4:
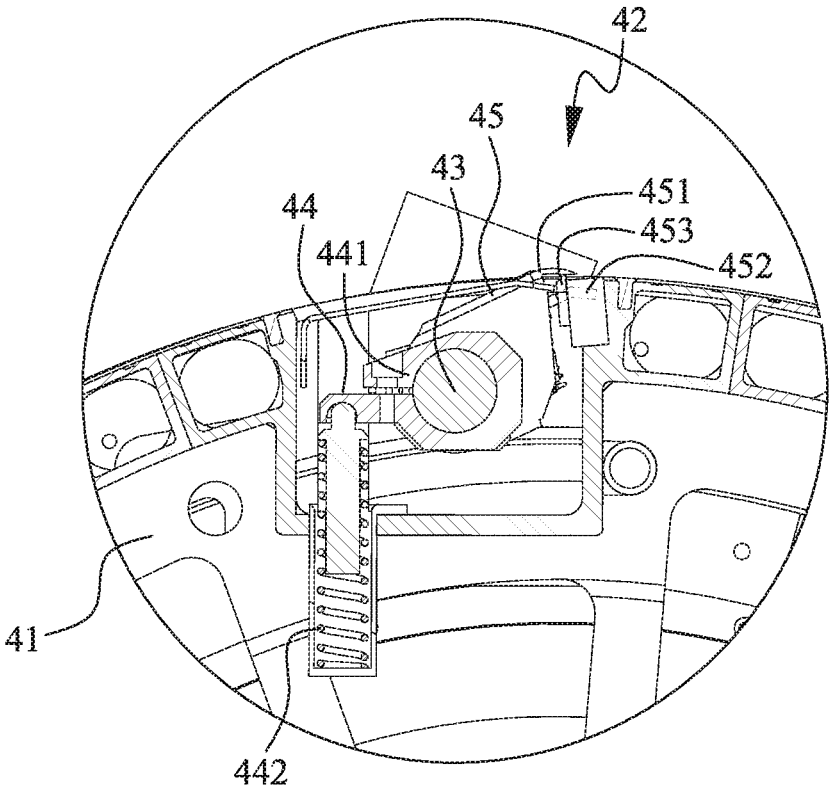
FIG. 4 shows a clamping unit of the rotary printing machine of the present invention maintains a clamped state when it is moved to a feeding position on the machine.
Figure 5:
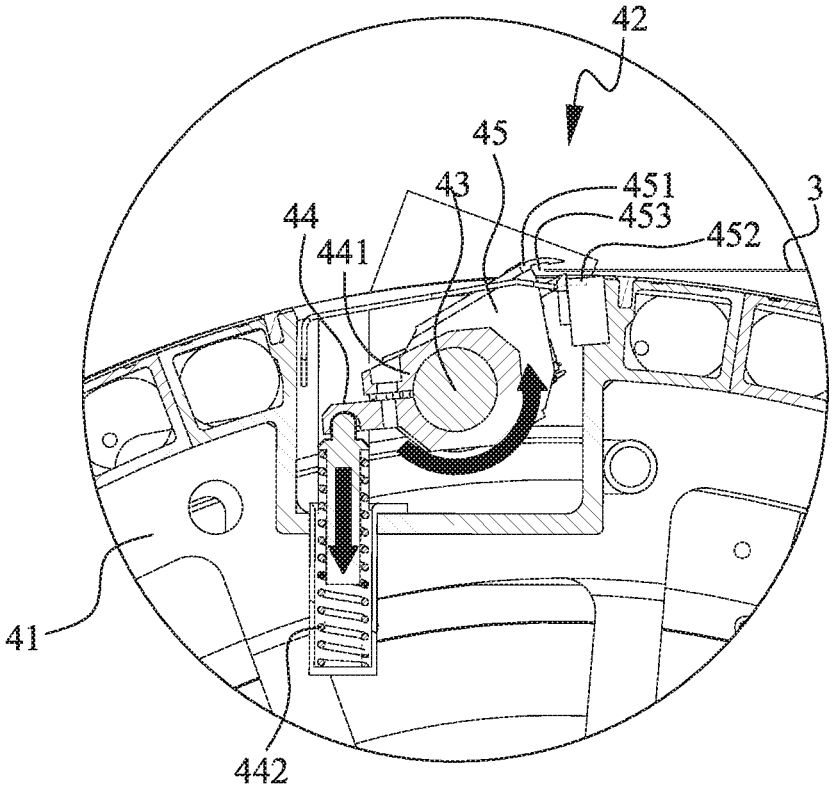
FIG. 5 shows the clamping unit of the rotary printing machine of the present invention is changed from the clamped state into an open state.
Figure 6:
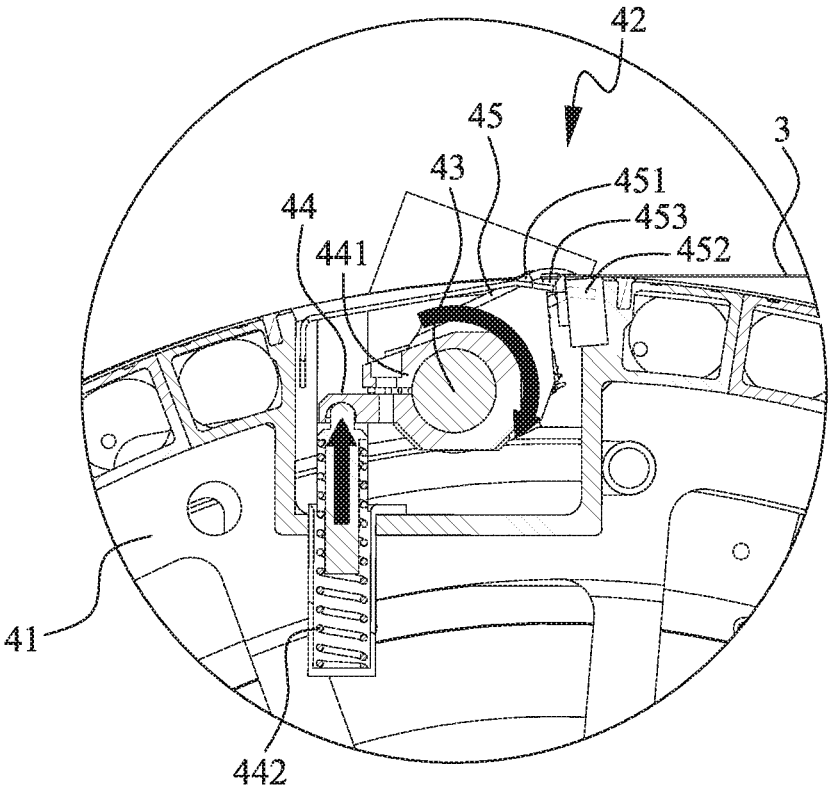
FIG. 6 shows the clamping unit of the rotary printing machine of the present invention is changed from the open state into the clamped state.

Please refer to FIGS. 4, 5 and 6. When the rotary shaft 43 is in an initial state as shown in FIG. 4, it is acted on by the reset units 44, such that the clampers 45 are maintained in a closed state, in which the workpiece 3 could not be fed into the clampers 45. When the clampers 45 are in the closed state, a clamping surface formed by the clampers 45 is locate adjacent to the circumferential surface of the cylinder body 41 to provide a clamping effect. When the rotary shaft 43 is rotated, the clampers 45 are brought to change from the closed state into an open state, allowing the workpiece 3 to be fed into or released from the clampers 45. When the clampers 45 are in the open state, an angle is formed between the clamping surface of the clampers 45 and the circumferential surface of the cylinder body 41 to provide a releasing effect.

Referring to FIG. 5. When the swing member 46 is brought by the feeding control mechanism 6 or the unloading control mechanism 7 to swing, the rotary shaft 43 is further brought by the swing member 46 to rotate, causing the clampers 45 to change from the closed state into the open state. Meanwhile, the reset unit 44 is caused to produce a resetting force.

As shown in FIG. 6, when the swing member 46 is no longer acted on by the feeding control mechanism 6 or the unloading control mechanism 7, the rotary shaft 43 is subjected to the resetting force of the reset unit 44 and returned from the open state to the closed state, bringing the clampers 45 to clamp the workpiece 3 thereto.

In an operable embodiment of the present invention, each of the clampers 45 includes a clamping section 451 and a pushing section 452, both of which are fixedly mounted on the rotary shaft 43. The clamping section 451 and the pushing section 452 are spaced from each other, so that a receiving space 453 is formed between them and the workpiece 3 can be fed into the receiving space 453. The reset unit 44 includes a fixing seat 441 and an elastic element 442. The fixing seat 441 is fixedly fitted on the rotary shaft 43. The elastic element 442 has two ends separately pressing against the fixing seat 441 and a surface of the printing cylinder 4, such that the elastic element 442 always pushes against the fixing seat 441.

Figure 7:
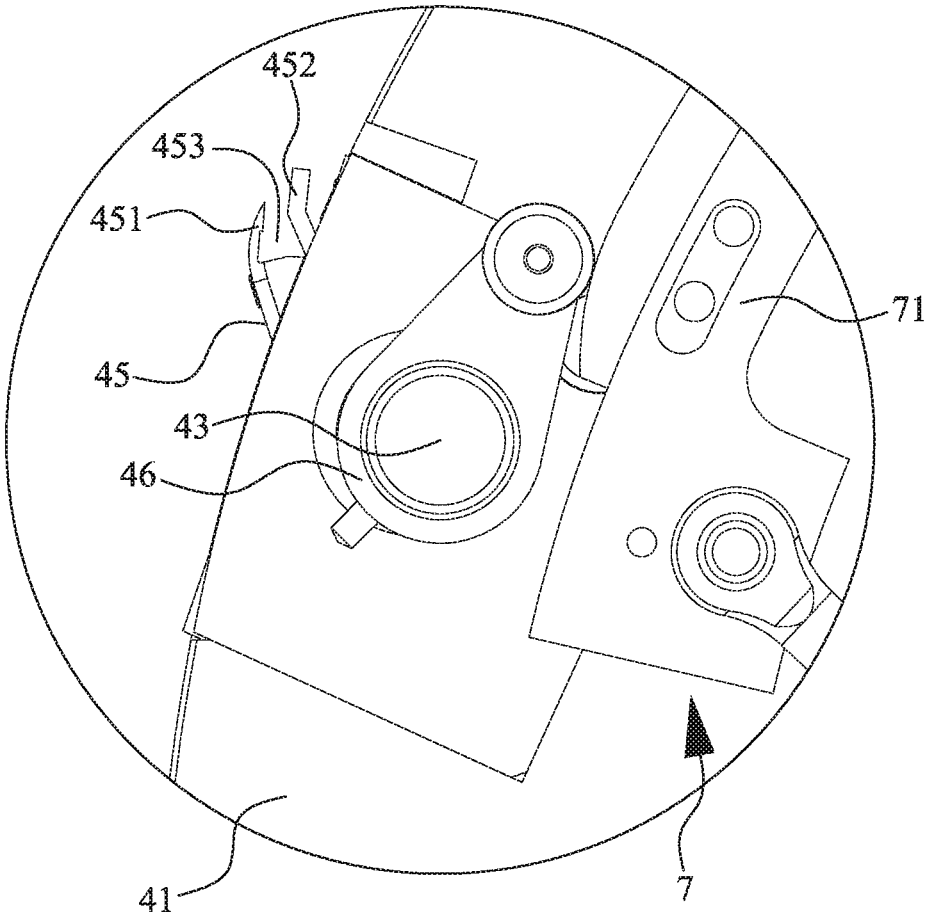
FIG. 7 shows the clamping unit of the rotary printing machine of the present invention is changed into the open state when it is moved to an unloading position on the machine.

When the rotary shaft 43 is acted on by the feeding control mechanism 6, the pushing section 452 overlaps with the printing cylinder 4 while a first angle is formed between the clamping section 451 and the surface of the printing cylinder 4. As can be seen FIG. 7, when the rotary shaft 43 is acted on by the unloading control mechanism 7, a second angle is formed between the pushing section 452 and the clamping section 451 and the surface of the printing cylinder 4. The second angle is larger than the first angle, Referring to FIG. 8. When the printing cylinder 4 is rotated in a printing operation, the feeding control mechanism 6 can be selectively controlled to touch or not to touch the swing member 46 when the clamping unit 42 on the rotating printing cylinder 4 is moved to a feeding position, so that the swing member 46 is swung or not swung. The feeding control mechanism 6 includes a driving source 60, a feeding linkage 61, and a feeding control unit 62.

Figure 9:
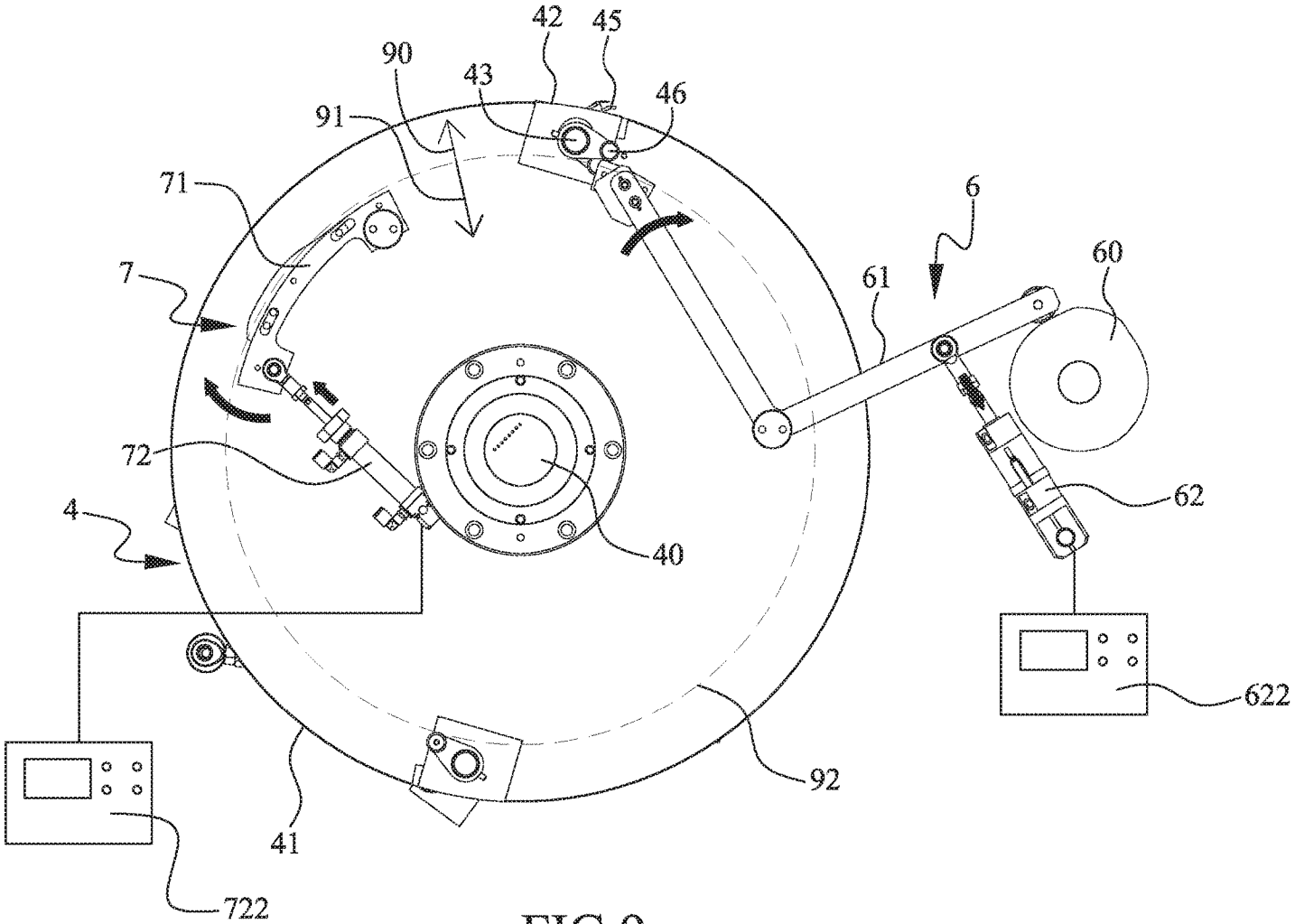
FIG. 9 is a side view showing the feeding control mechanism and an unloading control mechanism of the rotary printing machine of the present invention are respectively located at a position contactable with the clamping unit.

As shown in FIG. 9, the feeding linkage 61 is located adjacent to the driving source 60 and is driven by the driving source 60 to change between a first position 90, in which the feeding control mechanism 6 can touch the swing member 46, and a second position 91, in which the feeding control mechanism 6 can not touch the swing member 46. The arrow in FIG. 9 that radially outward extends from the dashed circle 92 indicates the first position 90, while the arrow radially inward extends from the dashed circle 92 indicates the second position 91.

The feeding control unit 62 is connected to the feeding linkage 61 for separating the feeding linkage 61 from the driving source 60, so that the feeding linkage 61 is maintained at the second position 91 without touching the swing member 46.

Figure 8:
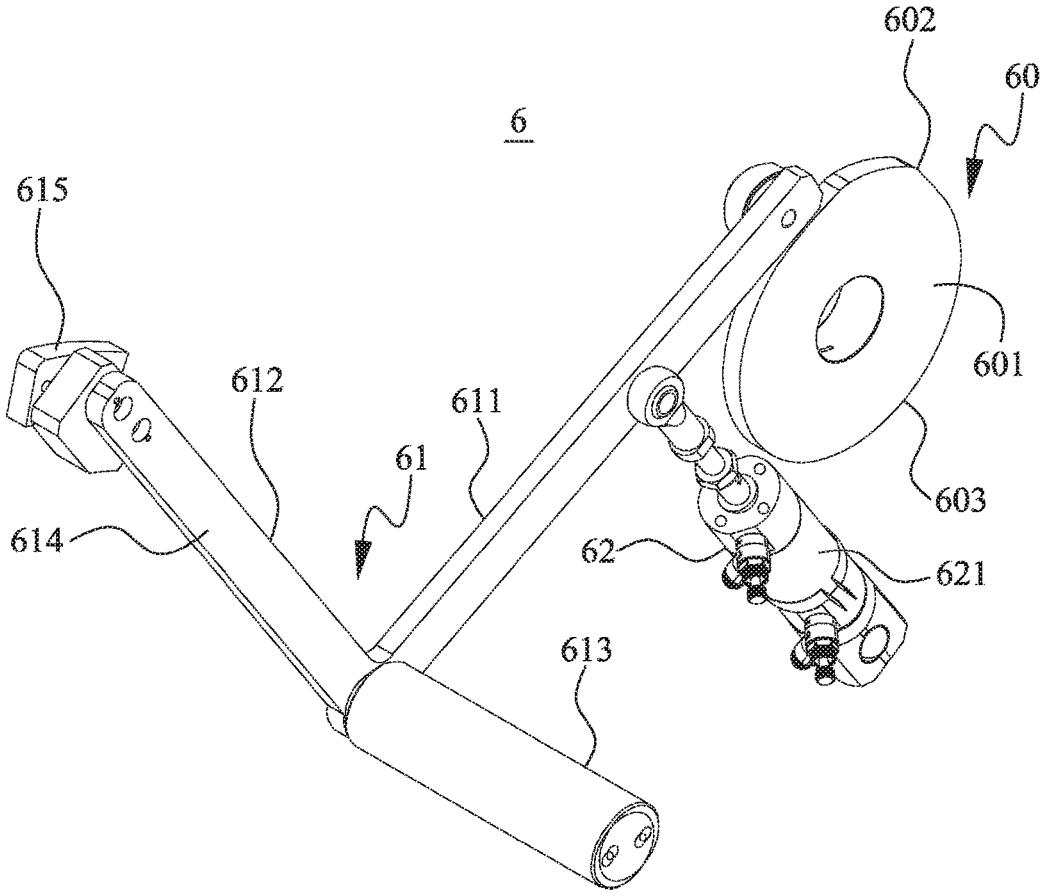
FIG. 8 is a perspective view of a feeding control mechanism for the rotary printing machine of FIG. 2.

In a preferred embodiment as shown in FIG. 8, the driving source 60 is configured as a cam 601. The feeding linkage 61 has a first link 611 and a second link 612, which are integrally formed to present an L-shape. The first link 611 is contactable with the driving source 60 to move along with the driving source 60. The feeding control unit 62 includes a first driving unit 621 and a first controller 622. The first driving unit 621 is connected to between the first controller 622 and the first link 611. The first controller 622 can change the first driving unit 621 between a retracted state and an extended state and thereby causes the first link 611 to change in position. The first driving unit 621 can be a pneumatic cylinder, a hydraulic cylinder or a motor.

The cam 601 has a first curved portion 602 and a second curved portion 603, which are different in curvature. The first curved portion 602 has a curvature larger than that of the second curved portion 603. Therefore, when the first curved portion 602 and the second curved portion 603 of the cam 601 sequentially act on the feeding linkage 61, the clampers 45 are brought to quickly change from the closed state into the open state. On the other hand, when the second curved portion 603 and the first curved portion 602 of the cam 601 sequentially act on the feeding linkage 61, the clampers 45 are brought to gently change from the open state into the closed state.

The first link 611 and the second link 612 are pivotally connected at their adjacent ends to a fixed bar 613 to form a pivot center at the adjacent ends. Another opposite end of the second link 612 can bring the swing member 46 to swing.

Figure 10:
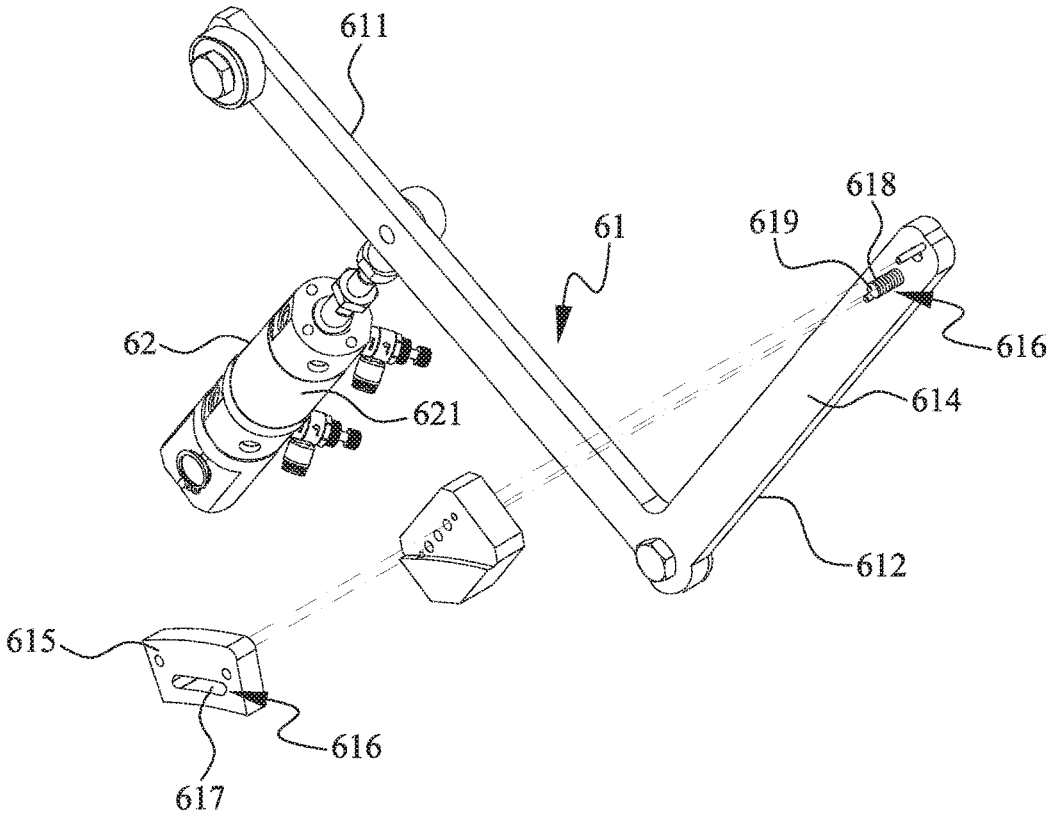
FIG. 10 is an exploded perspective view of the feeding control mechanism of FIG. 8.
Figure 11:
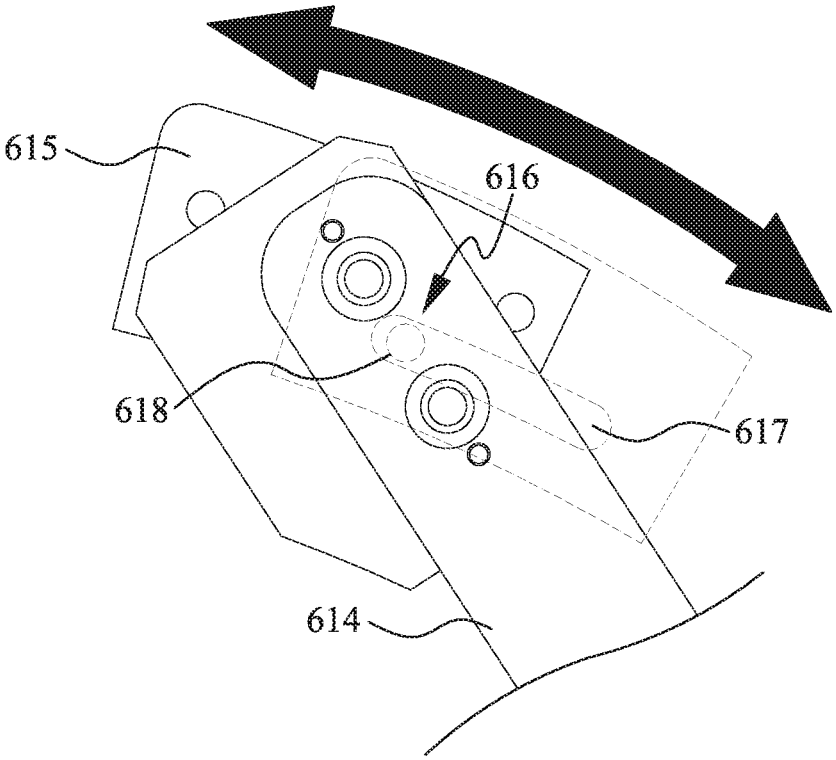
FIG. 11 shows the manner of adjusting an overall length of a feeding linkage of the feeding control mechanism of FIG. 8.

Please refer to FIGS. 10 and 11. The second link 612 includes a swing link body 614, a push head 615 connected to one side of a distal end of the swing link body 614 for causing the swing member 46 to swing, and a length-adjustment mechanism 616 located between the swing link body 614 and the push head 615.

The length-adjustment mechanism 616 includes a first limiting rail 617 and a first locking member 618 extended into the first limiting rail 617. The first limiting rail 617 can be formed on one of the swing link body 614 and the push head 615 while the first locking member 618 is mounted on the other one of the swing link body 614 and the push head 615.

The first locking member 618 includes a first bolt 619 and a first fastening element (not shown). When the first fastening element is loosened from the first bolt 619, the push head 615 can be moved in along the first limiting rail 617 relative to the swing link body 614, so as to change an overall length and an angular position of the second link 612. In this manner, it is able to control the size of the angle formed between the clampers 45 and the cylinder body 41 when the clampers 45 are in the open state.

Further, the first driving unit 621 is normally in a retracted state, enabling the cam 601 and the first link 611 to maintain a contacted and linked relation between them. Please refer to FIG. 12. When the first controller 622 changes the first driving unit 621 from the retracted state into an extended state, the first link 611 is pushed by the extended first driving unit 621 to move upward and accordingly separate from the cam 601, bringing the second link 612 to swing downward at the same time to a position unable to touch the swing member 46.

Please refer to FIG. 9. When the printing cylinder 4 is rotated in a printing operation, the unloading control mechanism 7 can be selectively controlled to touch or not to touch the swing member 46 when the clamping unit 42 on the rotating printing cylinder 4 is moved to an unloading position, so that the swing member 46 is swung or not swung. The unloading control mechanism 7 includes an unloading unit 71 and an unloading control unit 72. The unloading unit 71 is mounted to the first position 90 and is therefore able to touch the swing member 46 when the printing cylinder 4 is rotating. The unloading control unit 72 can switch the unloading unit 71 from the first position 90 to the second position 91, so that the unloading unit 71 is not able to touch the swing member 46, allowing the clampers 45 to change from the open state into the closed state.

Figure 13:
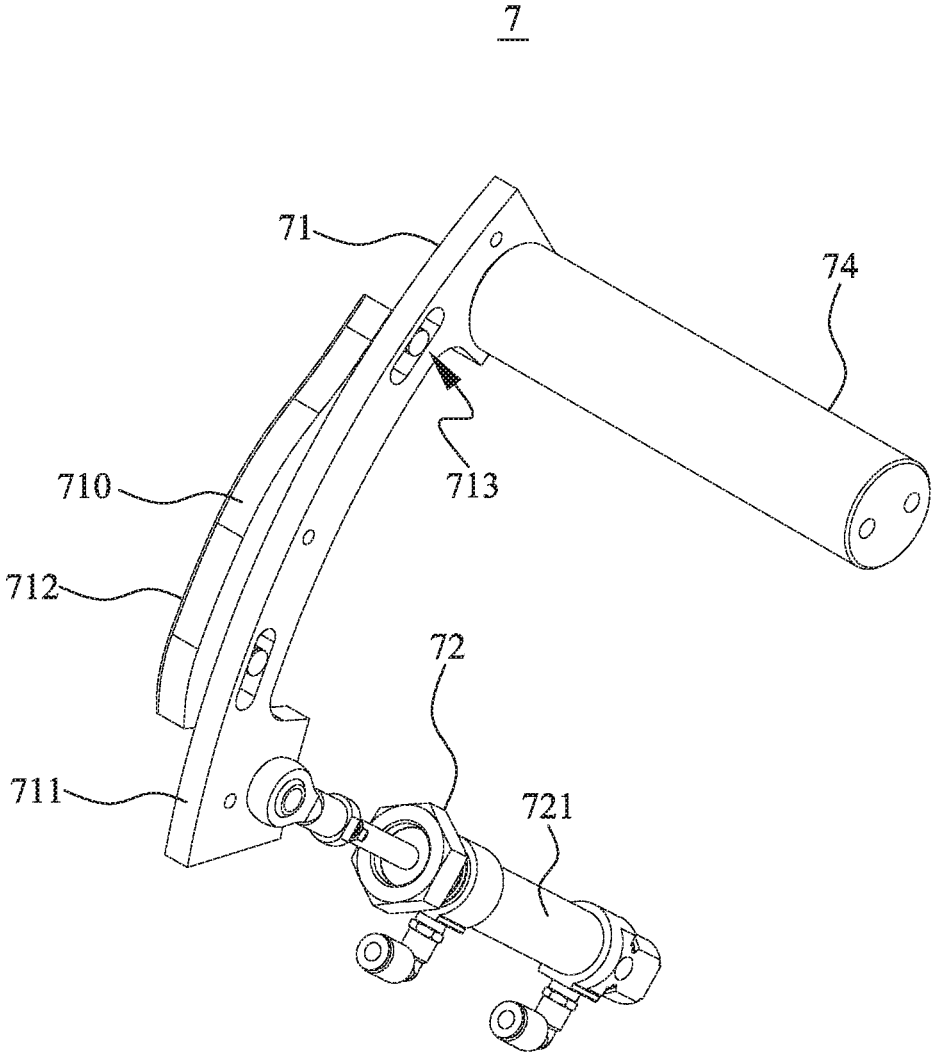
FIG. 13 is an assembled perspective view of the unloading control mechanism for the rotary printing machine of FIG. 2.

As can be seen in FIG. 13, the unloading unit 71 has an end fixedly connected to a bar 74 with a bolt 73 to serve as a pivot center, and another opposite end of the unloading unit 71 is locked to the unloading control unit 72 using a screw. On the unloading unit 71, there is a raised area 710 formed between the pivot center and the unloading control unit 72. The raised area 710 is higher than other areas of the unloading unit 71 located at two lateral sides of the raised area 710.

Figure 14:
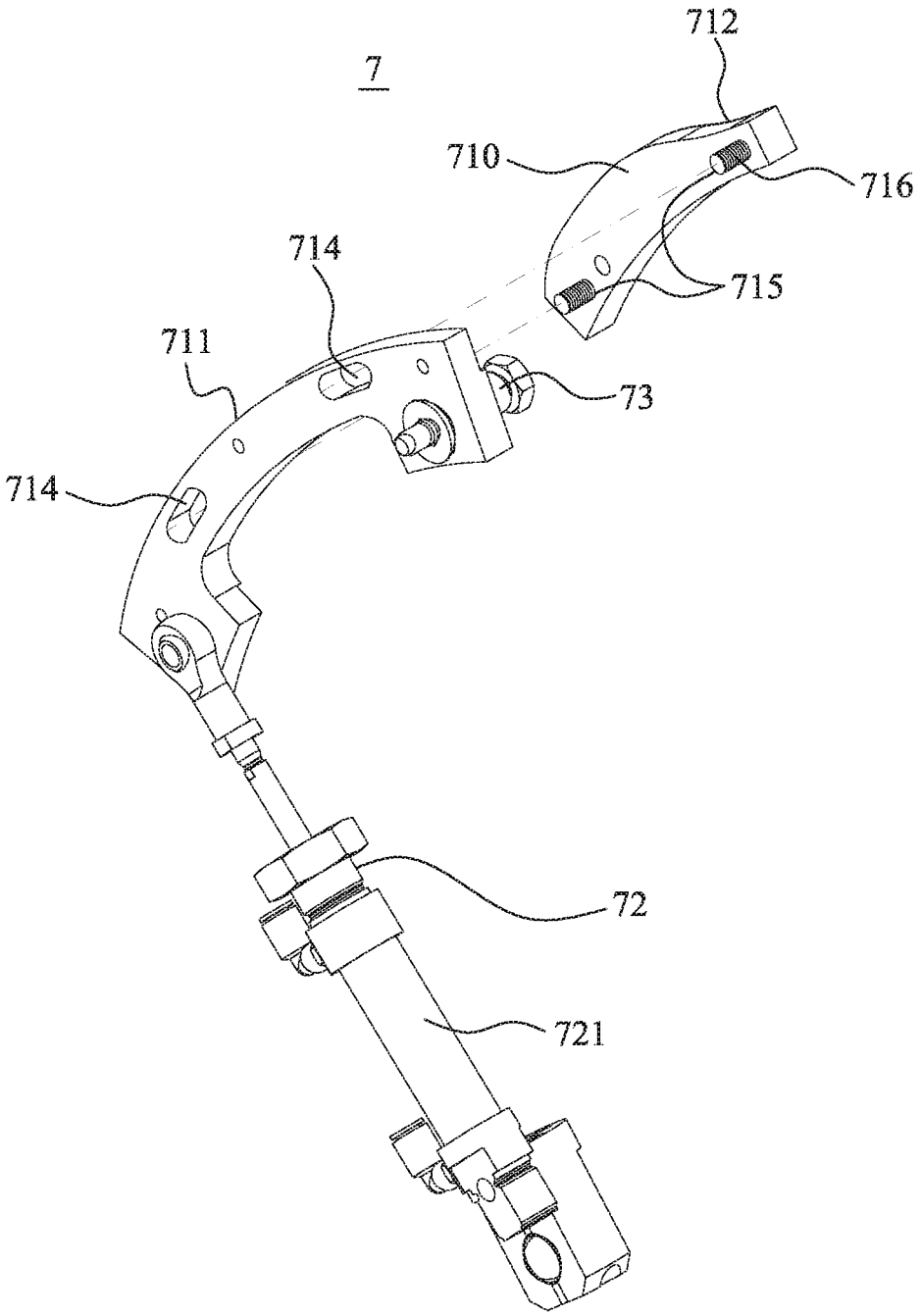
FIG. 14 is an exploded view of the unloading control mechanism of FIG. 13.
Figure 15:
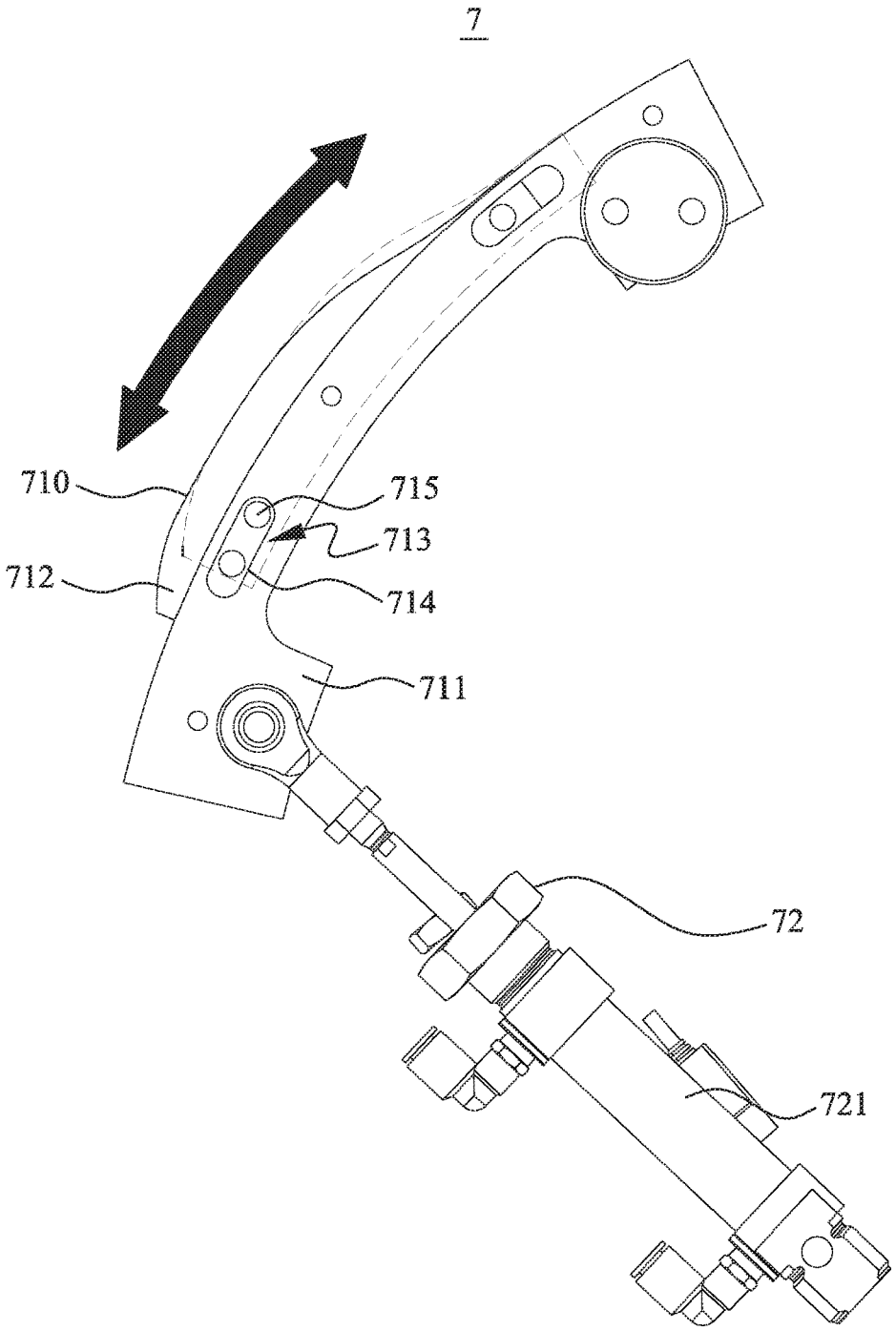
FIG. 15 shows the manner of adjusting the position of an unloading unit of the unloading control mechanism of FIG. 13.

As shown in FIGS. 14 and 15, the unloading unit 71 includes a curved arm portion 711, a raised arm portion 712 that forms the raised area 710, and a position-adjustment mechanism 713 formed on between the curved arm portion 711 and the raised arm portion 712.

The position-adjustment mechanism 713 includes at least one second limiting rail 714 and at least one second locking member 715. The second limiting rail 714 is formed on one of the curved arm portion 711 and the raised arm portion 712 while the second locking member 715 is mounted on the other one of the curved arm portion 711 and the raised arm portion 712.

the second locking member 715 includes a second bolt 716 and a second fastening element (not shown). When the second fastening element is loosened from the second bolt 716, the raised arm portion 712 can be moved in along the second limiting rail 714 on the curved arm portion 711, so as to change an overall height of the unloading unit 71. In this manner, it is able to control the size of the angle formed between the clampers 45 and the cylinder body 41 when the clampers 45 are in the open state.

Figure 12:
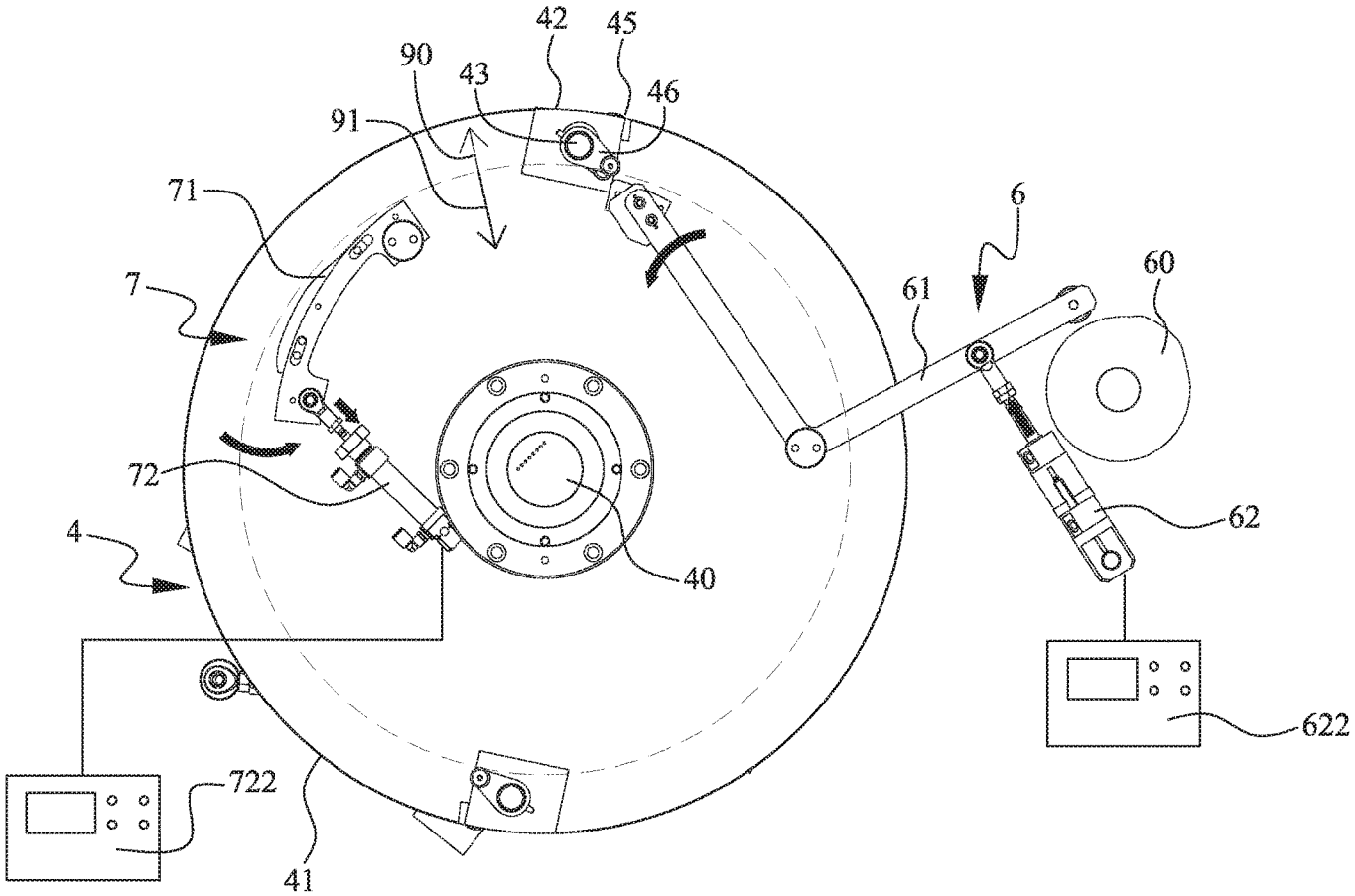
FIG. 12 is a side view showing the feeding control mechanism and the unloading control mechanism of the rotary printing machine of the present invention are respectively located at a position non-contactable with the clamping unit.

Please refer to FIG. 13 again. The unloading control unit 72 includes a second driving unit 721 and a second controller 722. The second driving unit 721 is connected to between the second controller 722 and the unloading unit 71. The second controller 722 can switch the second driving unit 721 between a retracted state and an extended state and thereby causes the unloading unit 71 to change in position. Similarly, the second driving unit 721 can be a pneumatic cylinder, a hydraulic cylinder or a motor. When the unloading unit 71 is located at the first position 90, the second driving unit 721 is in the extended state, as shown in FIG. 9. In the event the unloading unit 71 is to be switched from the first position 90 to the second position 91, the second controller 722 drives the second driving unit 721 to change from the extended state into the retracted state, as shown in FIG. 12.

In the present invention, the drying unit 8 is configured as an ultraviolet (UV) lamp for curing the ink that has been printed onto the workpiece 3 to form a pattern. The ink on the workpiece 3 is cured when the UV lamp irradiates UV light to heat and dry the ink. The cured ink is then stably held to the workpiece 3.

As shown in FIG. 9, in the case the workpiece 3 is to be printed only once on the rotary printing machine 2 of the present invention, the first driving unit 621 is controlled to the retracted state and the second driving unit 721 is controlled to the extended state. At this point, the printing cylinder 4 will circumferentially move the workpiece 3 for the printing unit 5 to print on the workpiece 3 only once. Then, the workpiece 3 is released from the clampers 45 at the unloading position.

However, in the case the workpiece 3 is to be repeatedly printed multiple times in a continuous manner on the rotary printing machine 2 of the present invention, the first driving unit 621 is controlled to the extended state and the second driving unit 721 is controlled to the retracted state. At this point, the printing cylinder 4 will circumferentially move the workpiece 3 repeatedly for the printing unit 5 to continuously print on the workpiece 3 multiple times. When a three-dimensional pattern formed of a predetermined ink layers has been printed on the workpiece 3, the second driving unit 721 is switched from the retracted state to the extended state, allowing the workpiece 3 to be released from the clampers 45 at the unloaded position.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A rotary printing machine, with which a workpiece can be printed only once or be repeated printed multiple times in a continuous manner, comprising:

a printing cylinder being provided with at least one clamping unit; the clamping unit each including a rotary shaft, on which a swing member, a reset unit and a plurality of clampers are provided; the clampers being normally maintained in a closed state and being changeable into an open state when the rotary shaft is rotated;

a printing unit being located over and adjacent to a surface of the printing cylinder for performing printing on the workpiece in cooperation with the printing cylinder;

a feeding control mechanism including a driving source, a feeding linkage and a feeding control unit; the driving source driving the feeding linkage to change between a first position, in which the feeding linkage can touch the swing member when the printing cylinder is rotating, and a second position, in which the feeding linkage can not touch the swing member when the printing cylinder is rotating; and the feeding control unit being able to separate the feeding linkage from the driving source, such that the feeding linkage is maintained at the second position; and an unloading control mechanism including an unloading unit and an unloading control unit; the unloading unit being mounted to the first position, in which the unloading unit can touch the swing member when the printing cylinder is rotating; and the unloading control unit being able to switch the unloading unit from the first position to the second position, in which the unloading unit can not touch the swing member when the printing cylinder is rotating.

2. The rotary printing machine as claimed in claim 1, wherein the driving source is configured as a cam; the cam having a first curved portion and a second curved portion that are different in curvature; the clampers being brought to quickly change from the closed state into the open state when the first curved portion and the second curved portion of the cam sequentially act on the feeding linkage; and the clampers being brought to gently change from the open state into the closed state when the second curved portion and the first curved portion of the cam sequentially act on the feeding linkage.

3. The rotary printing machine as claimed in claim 1, wherein the feeding control unit includes a first driving unit and a first controller; the first driving unit being normally in a retracted state, and the first controller being electrically connected to the first driving unit for controlling the first driving unit to change from the retracted state into an extended state; and wherein the unloading control unit includes a second driving unit and a second controller; the second driving unit being normally in an extended state, and the second controller being electrically connected to the second driving unit for controlling the second driving unit to change from the extended state into a retracted state.

4. The rotary printing machine as claimed in claim 1, wherein a clamping surface formed by the clampers overlaps with the printing cylinder to provide a clamping effect when the clampers are in the closed state; and an angle is formed between the clamping surface of the clampers and the surface of the printing cylinder to provide a releasing effect when the clampers are in the open state.

5. The rotary printing machine as claimed in claim 1, wherein each of the clampers includes a clamping section and a pushing section, both of which are fixedly mounted on the rotary shaft; the pushing section overlapping with the printing cylinder when the rotary shaft is acted on by the feeding control unit; and an angle being formed between the pushing section and the surface of the printing cylinder when the rotary shaft is acted on by the unloading control unit.

6. The rotary printing machine as claimed in claim 1, wherein the feeding linkage includes a first link and a second link; the first and the second link being fixedly connected to each other at their adjacent ends, which together form a pivot center; the driving source and the feeding control unit being operatively mounted on the first link, and another opposite end of the second link being movable to touch the swing member for rotating the rotary shaft.

7. The rotary printing machine as claimed in claim 6, wherein the second link includes a swing link body, a push head connected to one side of a distal end of the swing link body for causing the swing member to swing, and a length-adjustment mechanism located between the swing link body and the push head.

8. The rotary printing machine as claimed in claim 7, wherein the length-adjustment mechanism includes a first limiting rail and a first locking member; the first limiting rail being formed on one of the swing link body and the push head while the first locking member being mounted the other one of the swing link body and the push head; and the push head being movable in along the first limiting rail to thereby change an overall length of the second link.

9. The rotary printing machine as claimed in claim 1, wherein the unloading unit has an end fixed to the printing cylinder to serve as a pivot center and another opposite end connected to the unloading control unit; a raised area being formed on the unloading unit between the pivot center and the unloading control unit, and the raised area being higher than other areas of the unloading unit located at two lateral sides of the raised area.

10. The rotary printing machine as claimed in claim 1, wherein the unloading unit includes a curved arm portion, a raised arm portion that forms the raised area, and a position-adjustment mechanism formed on between the curved arm portion and the raised arm portion.

11. The rotary printing machine as claimed in claim 10, wherein the position-adjustment mechanism includes a second limiting rail and a second locking member; the second limiting rail being formed on one of the curved arm portion and the raised arm portion while the second locking member being mounted on the other one of the curved arm portion and the raised arm portion; and the raised arm portion being movable in along the second limiting rail when the second locking member is in a loosened state, enabling a change in a connection position of the raised arm portion relative to the curved arm portion.

12. The rotary printing machine as claimed in claim 1, further comprising a drying unit disposed over the unloading control mechanism for curing ink that has been printed onto the workpiece to form a pattern.

13. The rotary printing machine as claimed in claim 12, wherein the drying unit is configured as an ultraviolet lamp.

14. The rotary printing machine as claimed in claim 1, wherein the reset unit includes a fixing seat and an elastic element; the fixing seat being fixedly fitted on the rotary shaft and the elastic element having two ends separately pressing against the fixing seat and a surface of the printing cylinder, such that the elastic element always pushes against the fixing seat.

* * * * *